United States Patent [19]

Hoffmann-Glewe et al.

[11] Patent Number: 4,633,796

[45] Date of Patent: Jan. 6, 1987

[54] SEWING MACHINE MATERIAL FEEDER

[75] Inventors: Manfred Hoffmann-Glewe, Neuburg; Dieter Prause, Karlsruhe, both of Fed. Rep. of Germany

[73] Assignee: Pfaff Haushaltmaschinen, Fed. Rep. of Germany

[21] Appl. No.: 769,006

[22] Filed: Aug. 23, 1985

[30] Foreign Application Priority Data

Aug. 25, 1984 [DE] Fed. Rep. of Germany ..... 3431375

[51] Int. Cl.[4] ..... D05B 27/02

[52] U.S. Cl. ..... 112/314; 112/323

[58] Field of Search ..... 112/460, 308, 323, 314, 112/303

[56] References Cited

U.S. PATENT DOCUMENTS 3,055,325 9/1962 Adler ..... 112/460

4,512,273 4/1985 Skogward ..... 112/323

4,539,925 9/1985 Shim ..... 112/314

*Primary Examiner*—Werner H. Schroeder

*Assistant Examiner*—Andrew M. Falik

*Attorney, Agent, or Firm*—McGlew and Tuttle

[57] ABSTRACT

A feed device on a sewing machine having a feeder which is firmly connected with a horizontal shaft which is displaceably mounted in a feed rocker mounted fixed in a housing, and having a drive for the longitudinal axial movement of the shaft. For the reduction and simplification of the drive for the longitudinal movement of the shaft, this drive is arranged directly on the feed rocker. In addition, the horizontal shaft has a gear system with which a gear segment cooperates which together with its drive elements is mounted on a flange firmly connected with the feed rocker. The drive occurs via a step motor which is secured on a flange plate of the feed rocker lever.

4 Claims, 4 Drawing Figures

SEWING MACHINE MATERIAL FEEDER

FIELD AND BACKGROUND OF THE INVENTION

This invention relates in general to sewing machines and in particular to a new and useful feed device for materials which is connected with a horizontal shaft which is displaceably mounted in a feed rocker arm which is fixed in the housing of the sewing machine.

A similar feed device is known through U.S. Pat. No. 3,055,325. In this arrangement the drive of the transverse movement of the feeder occurs from a cam plate in the upper arm of the sewing machine, thus requiring considerable mechanical effort to produce the transverse movement and to transmit it to the feeder. This design, therefore, is trouble prone and expensive and operates unsatisfactorily in particular at high running speeds.

SUMMARY OF THE INVENTION

The invention provides a feed device having an uncomplicated drive and short transmission paths for the transverse movement of the feeder.

The arrangement of the invention results in an extremely simple drive which compared with the existing arrangement for the normal advance of a sewing machine requires few parts.

Accordingly it is an object of the invention to provide a sewing machine which has a feed for material which is connected to the drive for reciprocating the sewing needle and which operates on the material to be sewn as it is fed over a base or bottom portion of the machine and which comprises a feed rocker lever which has a first drive arm portion and a second feed rocker arm portion with an end pivotally mounted in the housing and wherein a horizontal shaft is mounted on the rocker arm portion for longitudinal movement from a shaft drive which is connected to the horizontal shaft for effecting its longitudinal movement and is mounted on the feed rocker arm portion.

A further object of the invention is to provide a feed device for a sewing machine with a feeder which is firmly connected with a horizontal shaft mounted displaceably in a feed rocker fixed on the housing, and which includes a drive for the longitudinal movement of the shaft which is controlled depending on the sewing machine and which is arranged beyond the feed rocker.

A further object of the invention is to provide a sewing machine feeding device which is a simple drive mechanism with short transmission paths for effecting transverse movement of the feeder for the material to be sewn.

A further object of the invention is to provide a feeding device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
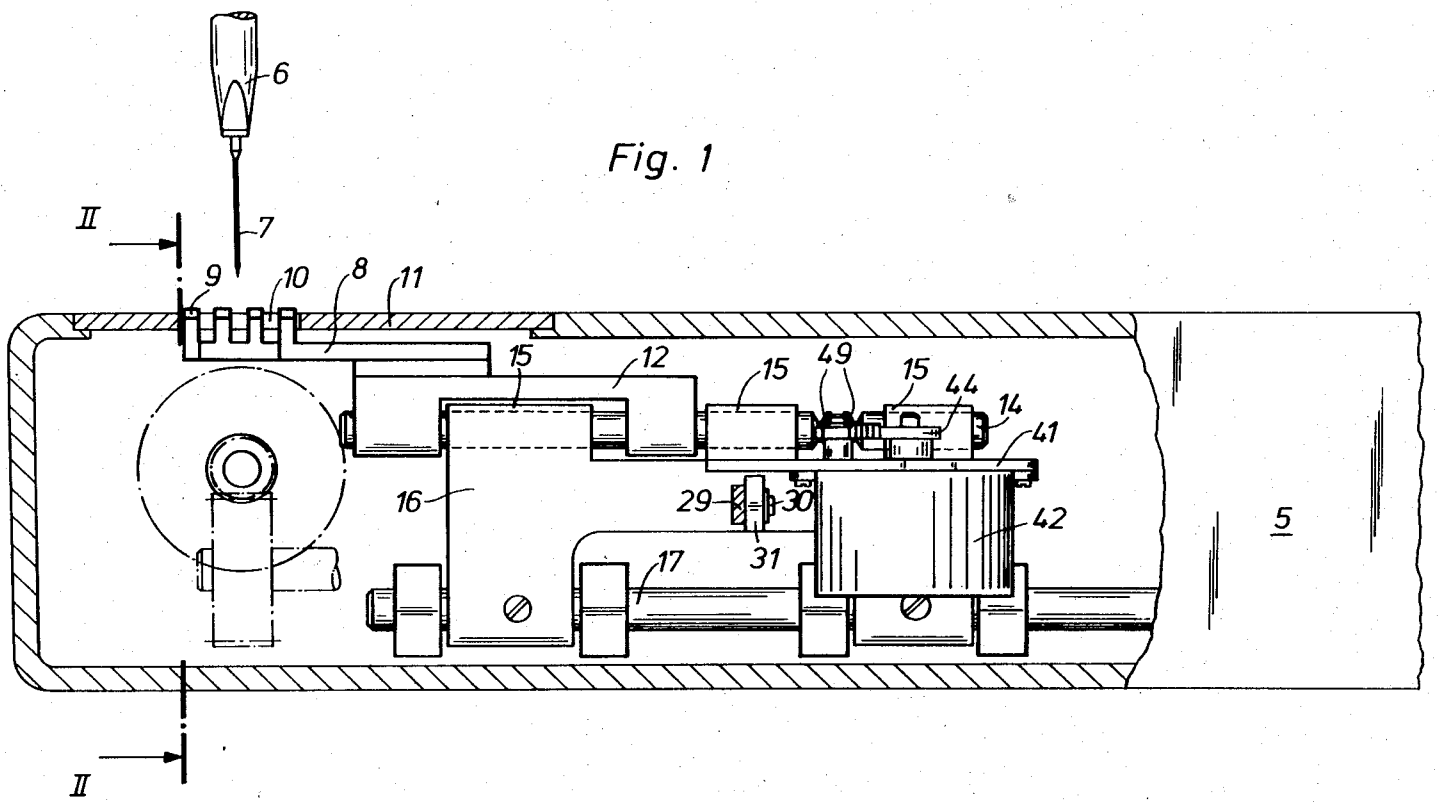
FIG. 1 is a view of the lower arm of a sewing machine from the front, partly in section.

Referring to the drawings in particular the invention embodied therein comprises a feed device for a sewing machine which has a drive for reciprocating a needle which operates on material to be sewn as it is fed over a lower arm portion or base 5 of the sewing machine. The feed mechanism includes a feed rocker 16. Rocker 16 is pivotally connected to a support 12 which, in turn, carries a feed dog 8. The feed rocker 16 is carried on an axle 17 mounted on a bracket of the lower arm 5 of the sewing machine. The feed rocker 16 provides a support for a swing shaft 14 which is movable longitudinally or axially on rocker 16. A drive for effecting the longitudinal movement of the shaft 14 is also carried on the feed rocker rocker 16 and it includes a step motor 42 mounted on a flange plate portion 41 of the rocker which drives through a gear mechanism to effect the longitudinal axial movement of the shaft 14.

FIG. 1 shows lower arm 5 of a sewing machine, together with a part of a needle bar 6, in which a needle 7 is fastened. The needle bar 6 cooperates with a shuttle (not shown) disposed in the lower arm 5, for stitch formation.

For the transport of work, a feeder or feed dog 8 is disposed in the lower arm 5. It is equipped with ridges 9 which act on the work across a cutout 10 in a stitch plate 11 covering the lower arm 5 in the region of the stitch formation point.

Figure 3:
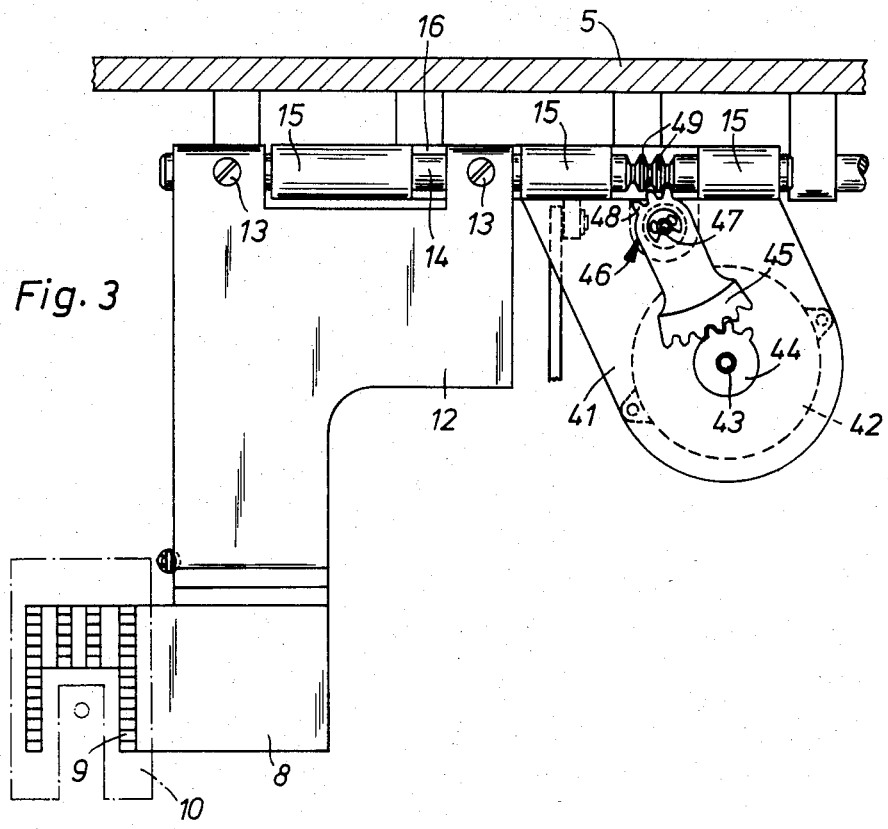
FIG. 3 is a section along line III—III of FIG. 2.

Feeder 8 is firmly connected to support 12 (FIG. 3) which by screws 13 is held on swing shaft or bar 14. The bar 14 is slidably fixed on spring shaft mounted in eyelets 15 of a feeder rocker 16 (FIG. 1) which is carried pivotably by axle 17 mounted in the lower arm 5. Engaging the support 12 from below is a lifting cam 18 or eccentric which is fastened on a shaft 19 mounted in the lower arm 5 and connected with the drive of the sewing machine.

Mounted in the lower arm 5 is a shaft 20 on which an eccentric 21 is attached. In known manner, (not shown) shaft 20 is in connection with the drive of the sewing machine. Biased against the eccentric 21 is an arm 22 of a double level 23 which is mounted on an axle 24 secured in the lower arm 5. The other arm 25 of the double level 23 is connected via a pin 26 with a link 27. The link 27 is connected by a pin 28 with a push rod 29 which by a bolt 30 is mounted by its other end at an eye 31 of the feed rocker 16. In this way, feed means are formed to drive the rocker 16 from the main drive of the sewing machine.

A spring 34 hooked to an eyelet 32 at the double lever 23 and at a bolt 33 fastened in the lower arm 5 pulls arm 22 of double lever 23 against the eccentric 21.

On pin 28 a slide-block 35 is rotatably mounted, which cooperates in known manner with a slideway 36.

Slideway 36 is secured on the end of a regulating shaft (not shown) to which a tooth segment 37 is secured. The segment 37 is in engagement with a pinion 38, which is firmly connected with a drive shaft 39 of a step motor 40 fastened in the lower arm 5.

Figure 2:
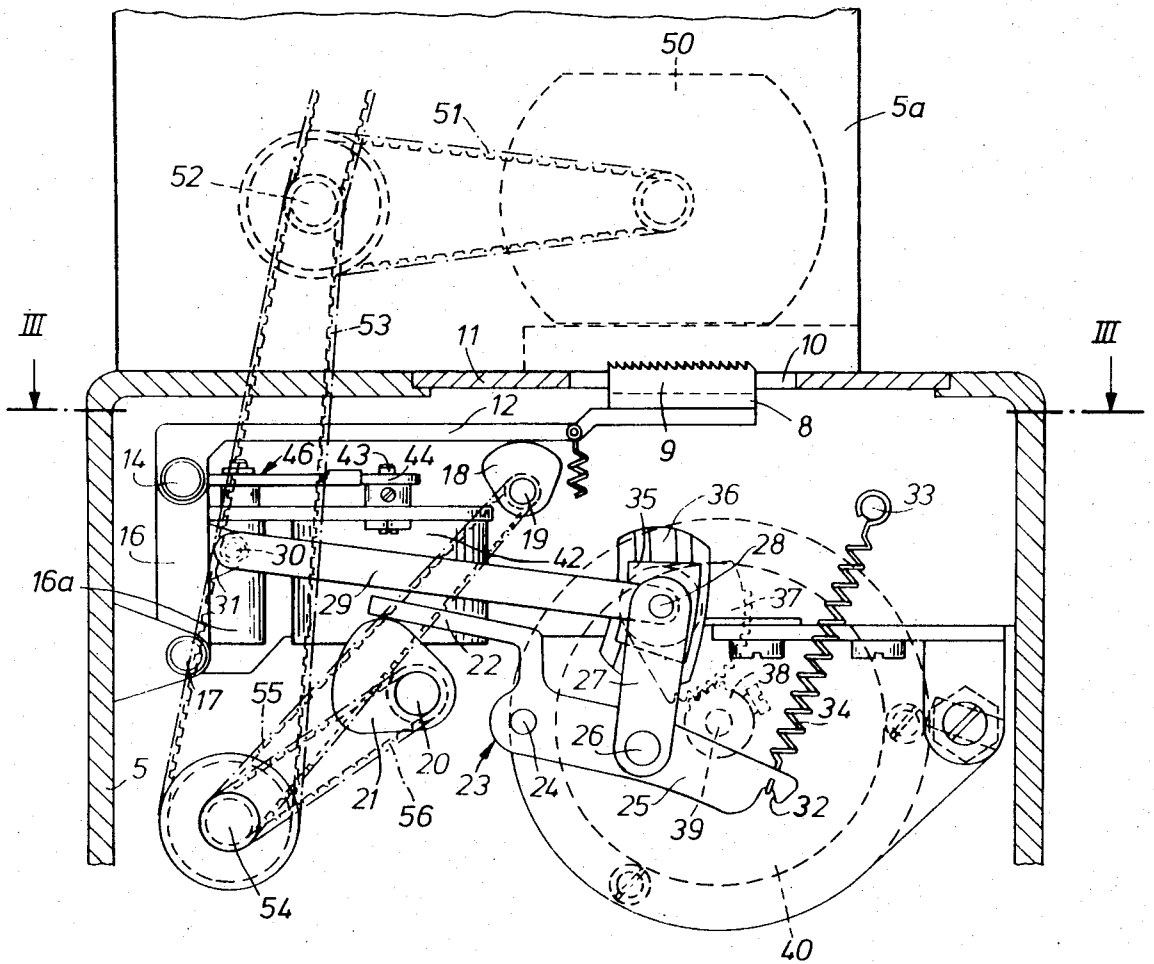
FIG. 2 is a section along line II—II of FIG. 1.

As shown in FIG. 2, motor 30 is secured in a sewing machine housing 5*a* of the sewing machine. Motor 50 drives toothed belt 51 which drives main shaft 52 mounted in housing 5*a*. This main shaft is connected in drive relationship via an additional toothed belt 53 with a shaft 54 mounted in the lower arm 5. Shaft 54 drives the shafts 19 and 20 via toothed belt 55 and 56 respectively.

Figure 4:
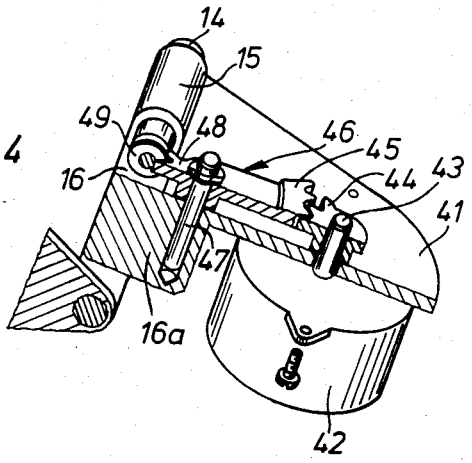
FIG. 4 is a perspective view of the drive unit for the transverse movement of the feeder, partly in section.

The feed rocker 16 (FIGS. 3 and 4) is equipped with a flange plate 41 perpendicular to it, on which a step motor 42 is secured. Secured on the drive shaft 43 of step motor 42 protruding through plate 41 is a gear segment 44 which cooperates with a gear segment 45 of a rocker 46 mounted on a bolt 47 fastened in a thickened portion 16*a* of the feed rocker 16. Motor 42 with rocker 46 form further drive means that are separate from the main sewing machine drive.

Rocker 46 has a gear segment 48 whose teeth cooperate with annularly formed teeth or a worm portion 49 of swing shaft 14. The teeth 49 have "O" pitch so that as rocker 16 ceases to swing, the motionless tooth segment 48 does not axially move the swing shaft 14.

During operation of the sewing machine, shaft 20 rotates, whereby the eccentric 21 slides the slide-block 35 in slideway 36 back and forth via the double lever 23 and the link 27 connected therewith. Depending on the angle adjustment of the slideway 36 given it by the step motor 40, slide-block 35 swivels the feed rocker 16 via rod 29 and thus imparts to the feeder 8 feed movements whose size and direction depend on the angular position of the slideway 36.

Synchronously with the rotation of shaft 20, the lift cam 18 is driven via shaft 19 and imparts lifting movements to the feeder 8.

For displacement of the work crosswise to the normal feed, the step motor 42 drives via pinion 44 the rocker 46 which laterally displaces, via the gear segment 48 and worm portion 49, the swing shaft 14 and hence the support 12 rigidly connected with it. The ridges 9 of feeder 8 connected therewith then take the work along as they are being displaced laterally. This displacement is in unison with the feed movement of feeder 8, i.e. the phase in which the ridges 9 of feeder 8 are raised over the stitch plate 11.

In sewing machines of the type described, the feeder is driven transversely to its normal motion of advance for the purpose of superimposing a slight transverse displacement on the normal advance motion of the material to be sewn. By doing this, zig-zag or straight line sitch seams retain a curved course so that, above all, a monogram pattern or scallop can be produced. The sideways motion of the feeder is very small so that the cut-out of the needle plate required for such a purpose need only be slightly wider than in the normal case. Problems which occur during the transport of the material that is sewn therefore do not arise.

While a specific embodiment of the invention has been shown and described in detail to illustrate the application of the principles of the invention, it will be understood that the invention may be embodied otherwise without departing from such principles.

What is claimed is:

1. A feed device for a sewing machine having a housing and a sewing machine main drive for reciprocating a needle which operates on material to be sewn, comprising a feeder rocker mounted in said housing, feed means connected between said rocker and the sewing machine main drive for moving said rocker in a first feed direction, a horizontal swing shaft mounted for axial movement on said rocker, said axial movement of said horizontal swing shaft being transverse to said first direction, a support with a feed dog connected to said swing shaft for axial movement with axial movement of said swing shaft, and further drive means which are separate from the sewing machine main drive, said further drive means being mounted on said feed rocker and being operatively connected to said swing shaft for moving said swing shaft axially.

2. A feed device for a sewing machine having a housing and a sewing machine main drive for reciprocating a needle which operates on material to be sewn, comprising a feed rocker mounted in said housing, feed means connected between said rocker and the sewing machine main drive for moving said rocker in a first feed direction, a horizontal swing shaft mounted for axial movement on said rocker, said axial movement of said horizontal swing shaft being transverse to said first direction, a support with a feed dog connected to said swing shaft for axial movement with axial movement of said swing shaft, and further drive means which are separate from the sewing machine main drive, said further drive means being mounted on said feed rocker and being operatively connected to said swing shaft for moving said shift axially, said further drive means comprising a flange plate fixed to said feed rocker, a drive motor mounted on said flange plate and a gear segment drive engaged between said drive motor and said swing shaft.

3. A feed drive for a sewing machine having a housing and a sewing machine main drive for reciprocating a needle which operates on material to be sewn, comprising a feed rocker mounted in said housing, feed means connected between said rocker and the sewing machine main drive for moving said rocker in a first feed direction, a horizontal swing shaft mounted for axial movement on said rocker, said axial movement of said horizontal swing shaft being transverse to said first direction, a support with a feed dog connected to said swing shaft for axial movement with axial movement of said swing shaft, and further drive means which are separate from the sewing machine main drive, said further drive means being mounted on said feed rocker and being operatively connected to said swing shaft for moving said swing shaft axially, said further drive means comprising a step motor mounted on said feed rocker and operatively engaged with said swing shaft for axially moving said swing shaft on said rocker.

4. A feed drive according to claim 3, wherein said feed rocker is pivotally mounted to said housing, and further comprising an eccentric driven by said sewing machine main drive and engaged with said support for raising and lowering said support and feed dog, said swing shaft having teeth defined thereon, and a toothed rocker engaged with said teeth of said swing shaft and operatively connected to said step motor for pivotal movement to axially move said swing shaft.

* * * * *